US007946585B2

(12) United States Patent
Grist et al.

(10) Patent No.: US 7,946,585 B2
(45) Date of Patent: May 24, 2011

(54) MECHANICAL BALL PROJECTION GAME DEVICES

(75) Inventors: Elizabeth A. Grist, Baltimore, MD (US); Ryan Singh, Loxahatchee, FL (US)

(73) Assignee: T.E. Brangs, Inc., Baltimore, MD (US)

( * ) Notice: Subject to any disclaimer, the term of this patent is extended or adjusted under 35 U.S.C. 154(b) by 187 days.

(21) Appl. No.: 12/239,421

(22) Filed: Sep. 26, 2008

(65) Prior Publication Data

US 2009/0085286 A1 Apr. 2, 2009

Related U.S. Application Data

(60) Provisional application No. 60/995,628, filed on Sep. 26, 2007.

(51) Int. Cl.
*A63F 7/00* (2006.01)

(52) U.S. Cl. ..... 273/119 R; 273/121 D; 273/122 R

(58) Field of Classification Search ..... 273/119 R, 273/121 D, 121 R, 122 R, 123 R, 125 R
See application file for complete search history.

(56) References Cited

U.S. PATENT DOCUMENTS

| | | | | | |
|---|---|---|---|---|---|
| 2,308,263 | A | | 1/1943 | Bengner | |
| 4,239,220 | A | * | 12/1980 | Kurita | 273/127 R |
| 4,239,222 | A | * | 12/1980 | Hori | 273/129 W |
| 4,244,575 | A | * | 1/1981 | Hori | 273/127 D |
| 4,269,413 | A | * | 5/1981 | Langieri | 273/121 R |
| 4,361,327 | A | | 11/1982 | Kurita et al. | |
| 4,504,057 | A | | 3/1985 | Wiczer | |
| 5,088,736 | A | * | 2/1992 | Chuang | 273/121 R |
| 5,121,919 | A | | 6/1992 | Martti | |
| 5,149,093 | A | | 9/1992 | Schilling et al. | |
| 5,310,184 | A | | 5/1994 | Grist | |
| 5,405,142 | A | * | 4/1995 | Arad et al. | 273/118 R |
| 5,415,401 | A | * | 5/1995 | Nagasaka | 273/110 |
| 5,509,656 | A | | 4/1996 | Berger et al. | |
| 5,664,779 | A | | 9/1997 | Soovajian, Jr. | |
| 5,730,441 | A | | 3/1998 | Gibbons et al. | |
| 5,769,418 | A | | 6/1998 | Gilbert et al. | |
| 5,988,637 | A | | 11/1999 | Dickerson | |
| 6,022,020 | A | | 2/2000 | Nishikawa | |
| 6,497,407 | B2 | | 12/2002 | Humphrey | |
| 6,598,876 | B1 | | 7/2003 | Pierce et al. | |
| 7,070,506 | B1 | | 7/2006 | Ropp et al. | |
| 7,118,105 | B2 | | 10/2006 | Benevento | |
| 7,264,155 | B2 | | 9/2007 | Halbur et al. | |
| 7,281,976 | B2 | | 10/2007 | Okada et al. | |
| 2009/0085286 | A1 | * | 4/2009 | Grist et al. | 273/121 D |

* cited by examiner

*Primary Examiner* — Raleigh W. Chiu
(74) *Attorney, Agent, or Firm* — Garrett IP, L.L.C.

(57) ABSTRACT

Mechanical ball projection game devices, including game devices having mechanically-actuated ball loader assemblies, and game devices to release a tangible prize upon game balls reaching or entering a prize location to release a tangible prize upon game balls reaching or entering a prize location. Game devices disclosed herein include prize inserts that may be configured to receive one or more of paper currency, gift cards, financial transaction cards, greeting cards, toys, and candy. Mechanical ball projection game devices may include user-controllable features to redirect ball travel, features to guide and obstruct ball travel, and ball projector devices.

17 Claims, 17 Drawing Sheets

MECHANICAL BALL PROJECTION GAME DEVICES

BACKGROUND

Ball projection game devices include pin-ball game devices having paddles or flippers to redirect ball travel. Ball projection game devices are typically relatively large, electrically operated, mechanically complex, and expensive to manufacture.

Relatively small and inexpensive non-ball projection game devices include maze games that release a tangible prize upon guiding game balls through a maze.

BRIEF DESCRIPTION OF THE DRAWINGS/FIGURES

Figure 4:
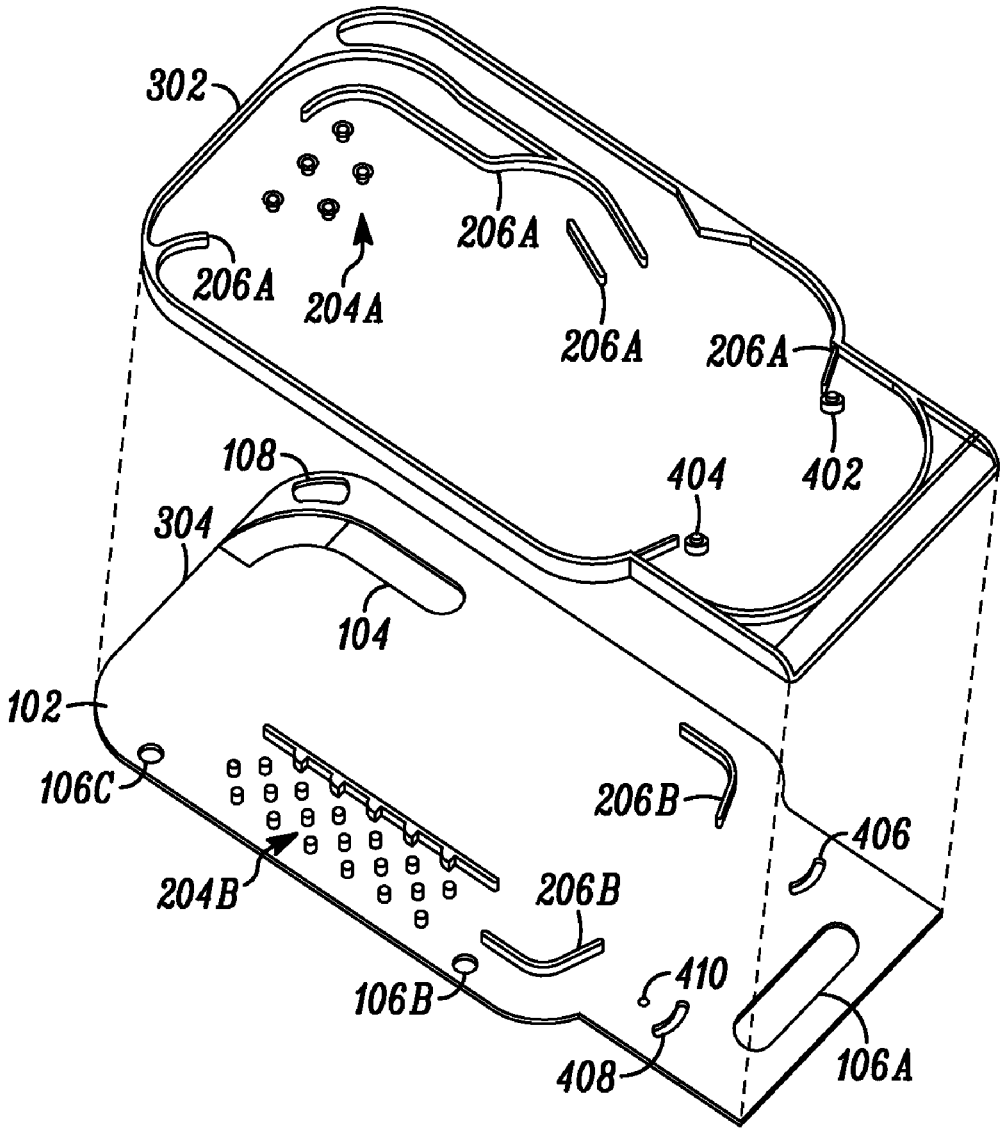

FIG. 4 is a perspective view of a cover 302 and a game plate 304 of game device 200.

Figure 5:
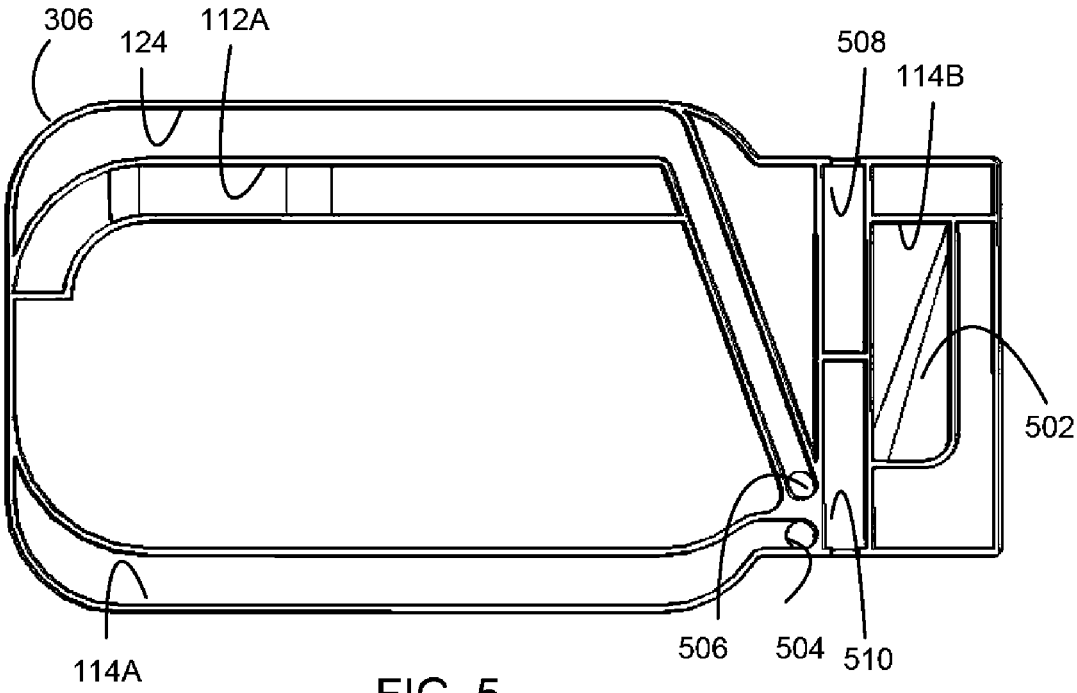

FIG. 5 is a top view of a ball passage tray 306 of game device 200.

Figure 6:
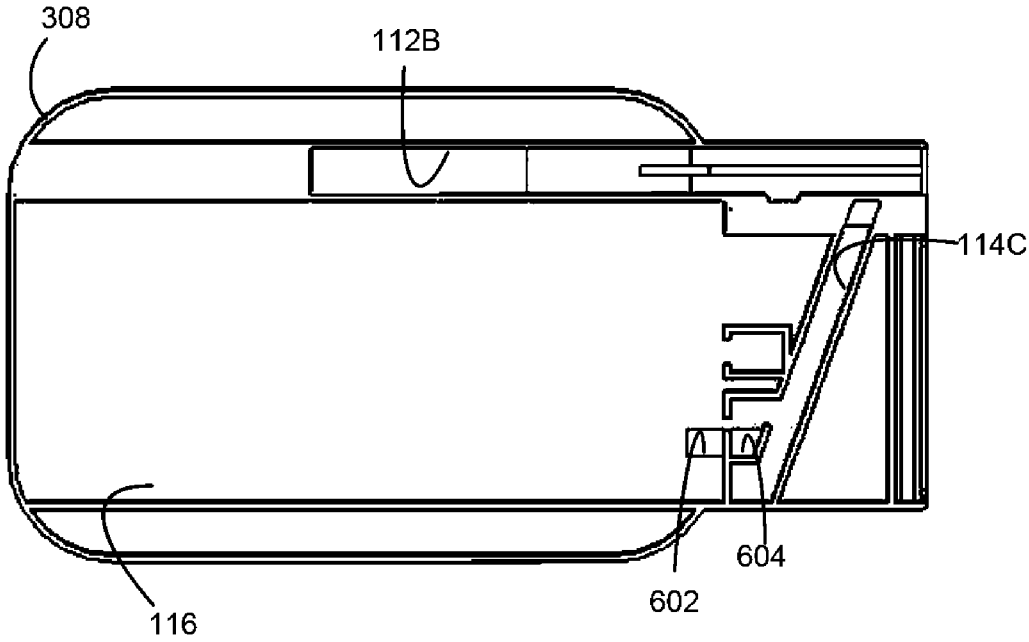

FIG. 6 is a top view of a reload and prize chamber tray 308 of game device 200.

Figure 7:
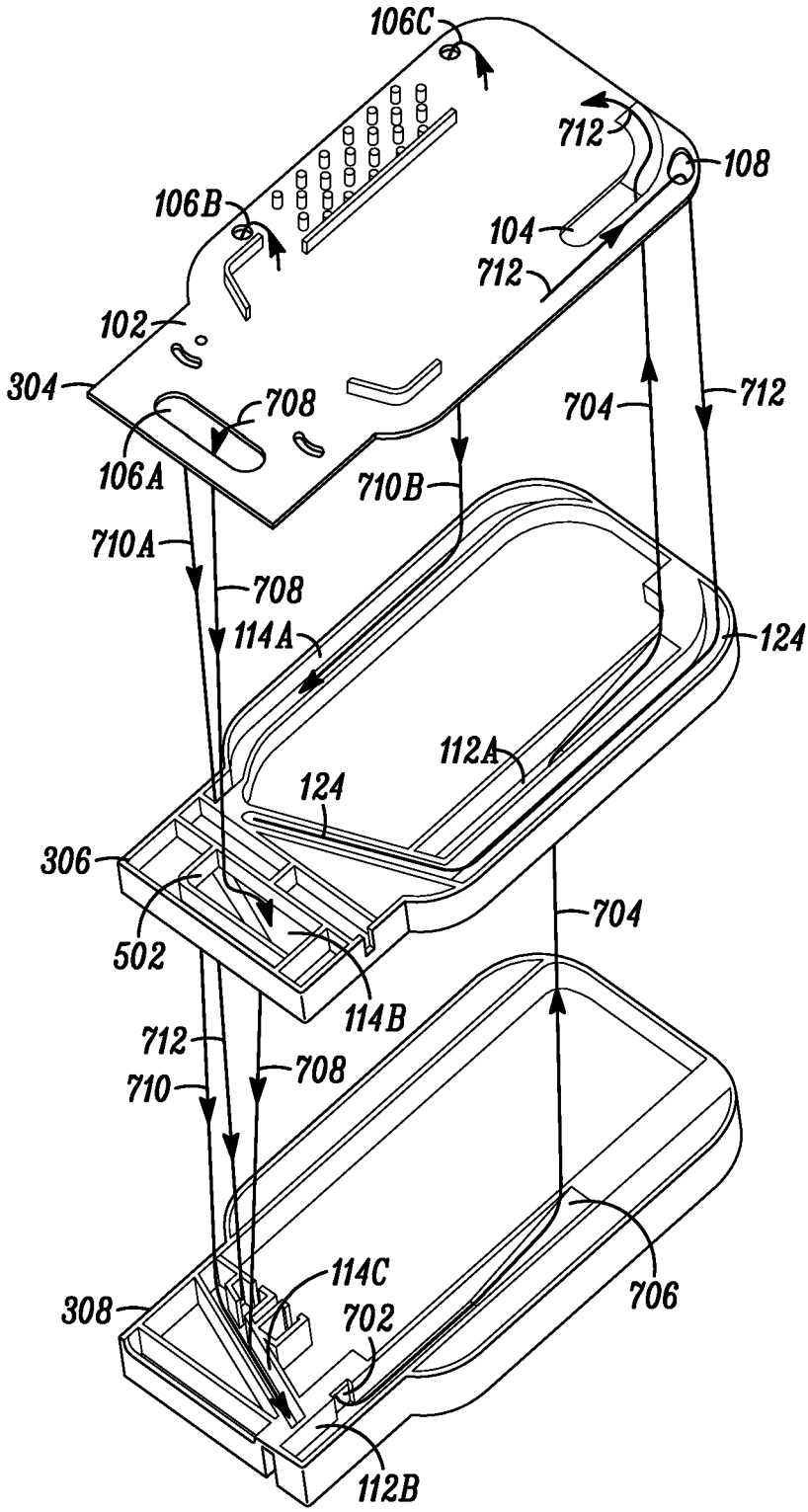

FIG. 7 is a perspective view of game plate 304, ball passage tray 306, and reload and prize chamber tray 308, including illustrations of exemplary ball travel.

Figure 8:
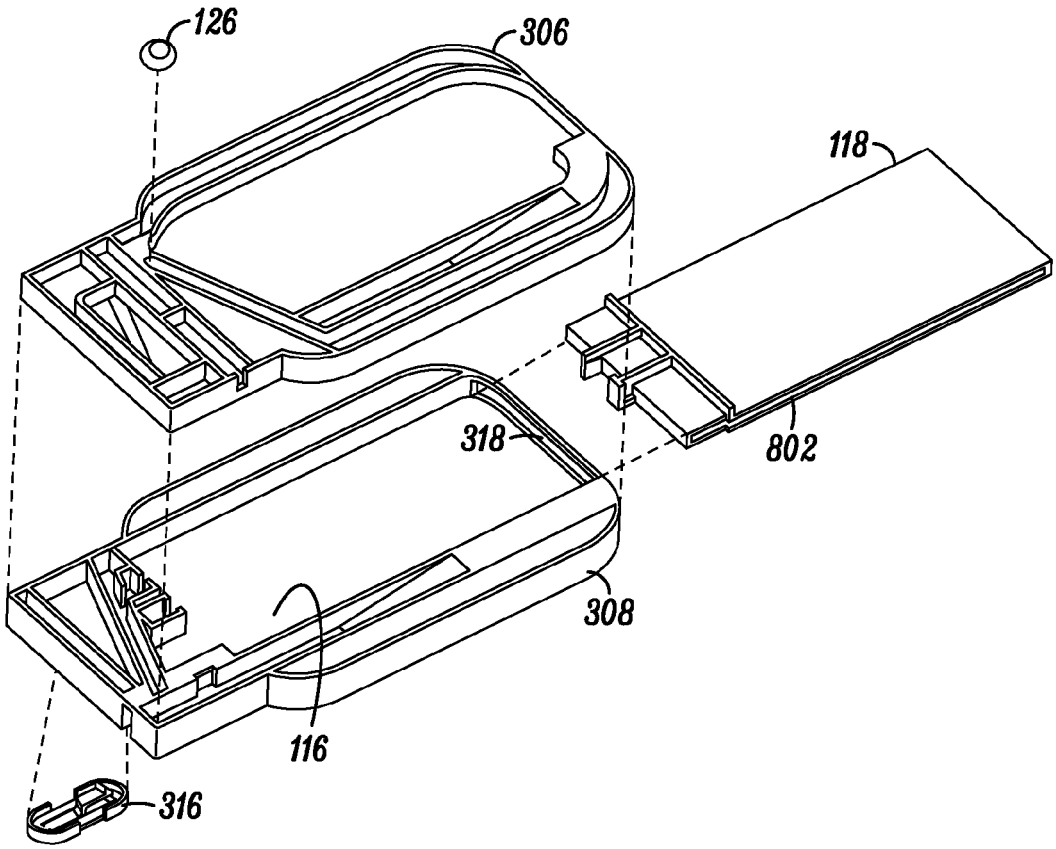

FIG. 8 is a perspective view of ball passage tray 306, reload and prize chamber tray 308, a prize insert 118, a prize insert release button 126, and a prize insert release clip 316.

Figure 9:
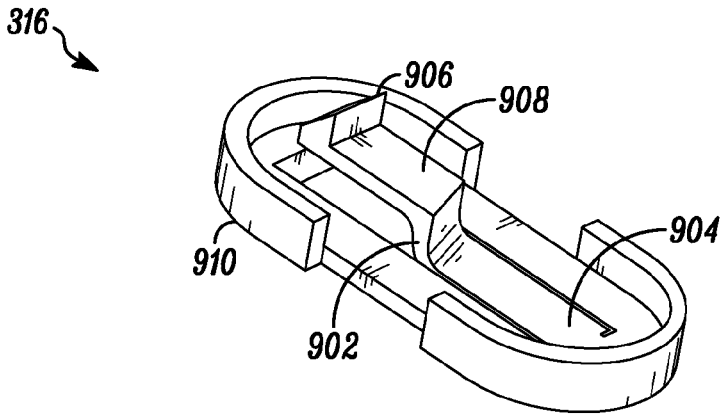

FIG. 9 is a perspective view of prize insert release clip 316.

Figure 10:
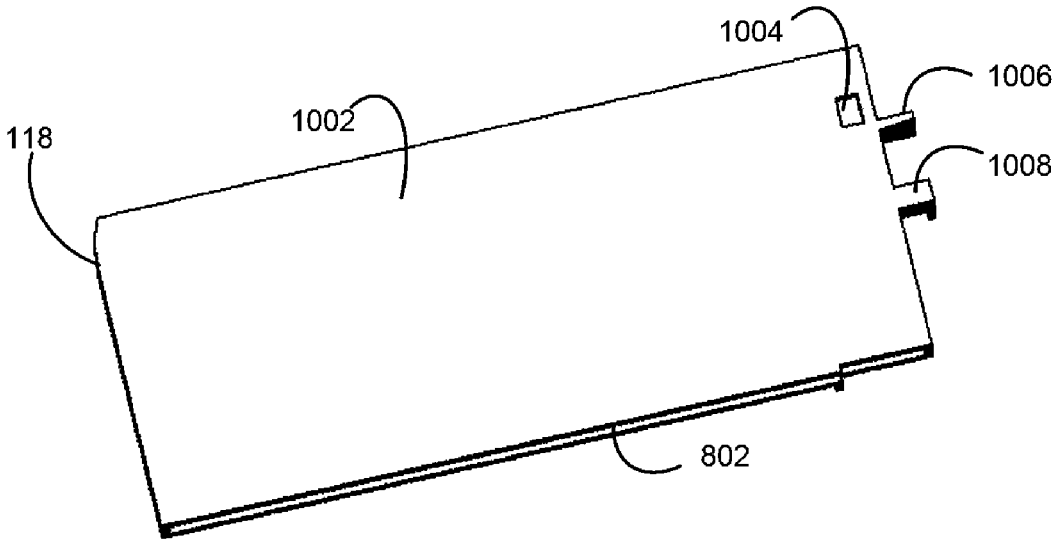

FIG. 10 is a perspective view of prize insert 118.

Figure 11:
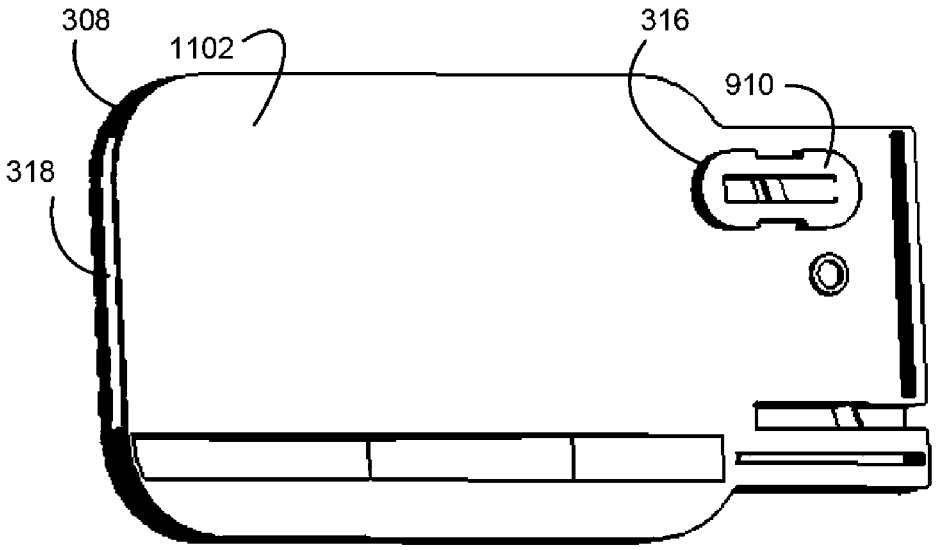

FIG. 11 is a perspective view of a rear surface of reload and prize chamber tray 308.

Figure 12:
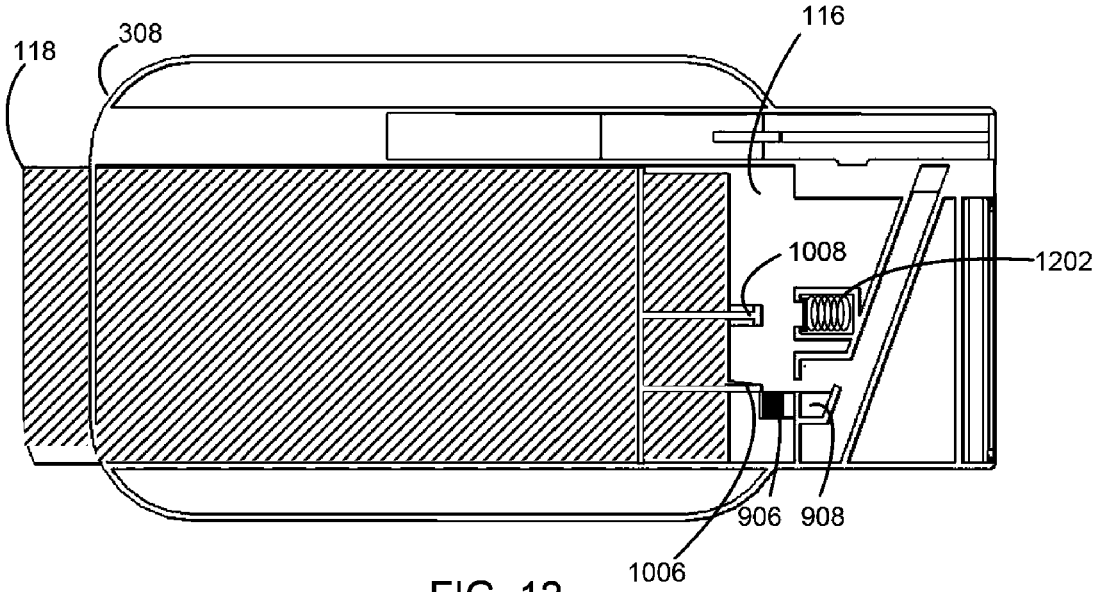

FIG. 12 is a top view of reload and prize chamber tray 308 and prize insert 118.

Figure 13:
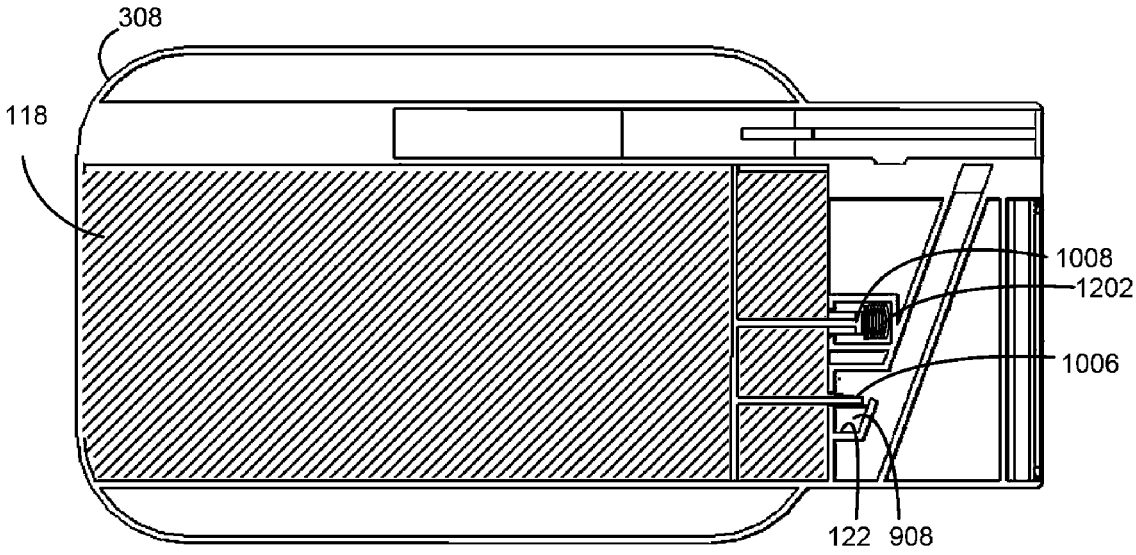

FIG. 13 is another top view of reload and prize chamber tray 308 and prize insert 118.

Figure 14:
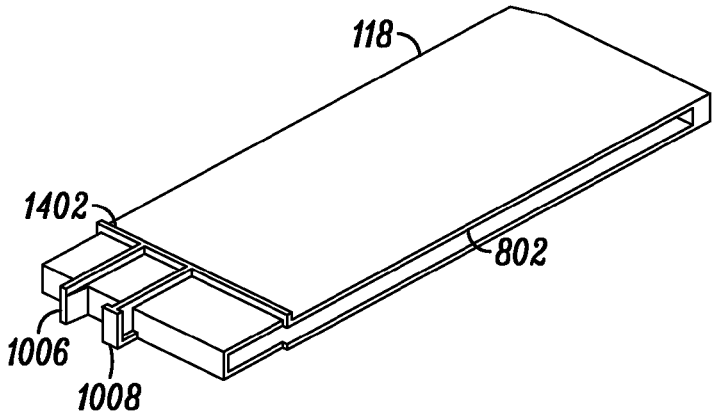

FIG. 14 is another perspective view of prize insert 118.

Figure 15:
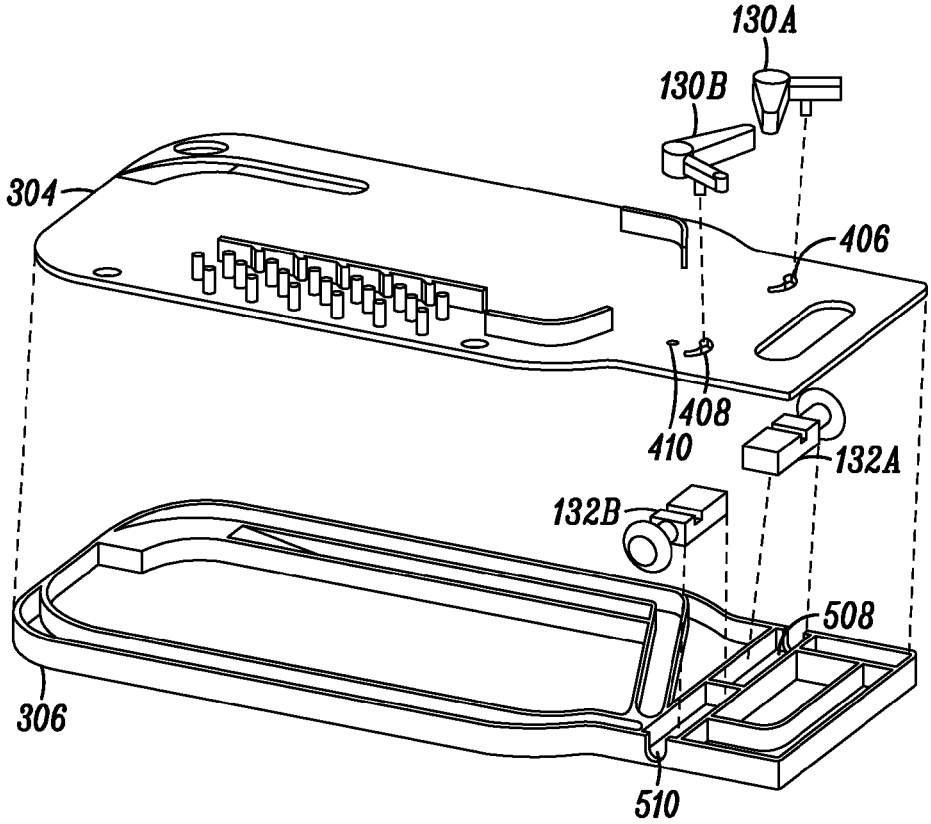

FIG. 15 is a perspective view of game plate 304, ball passage tray 306, paddles 130A and 130B, and depressible buttons 132A and 132B.

Figure 16:
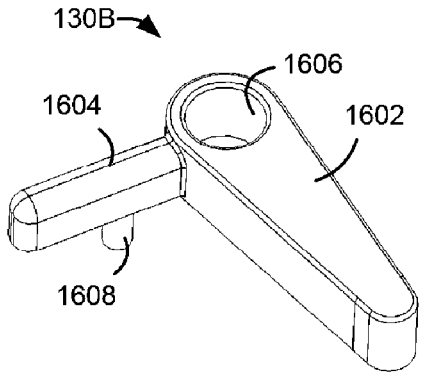

FIG. 16 is a perspective view of paddle 130B.

Figure 17:
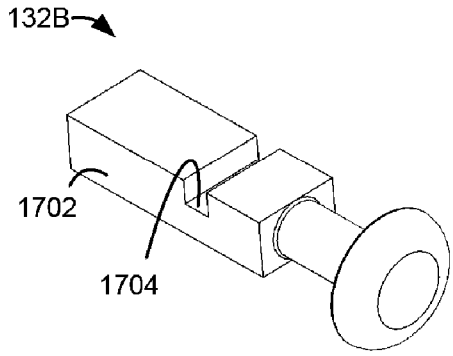

FIG. 17 is a perspective view of depressible button 132B.

Figure 18:
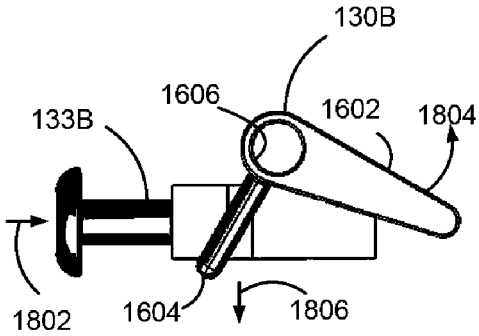

FIG. 18 is a top view of paddle 130B and depressible button 132B.

Figure 19:
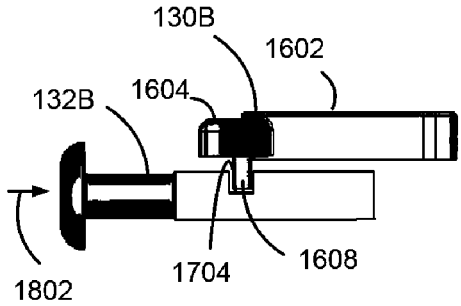

FIG. 19 is a side view of paddle 130B and depressible button 132B.

Figure 20:
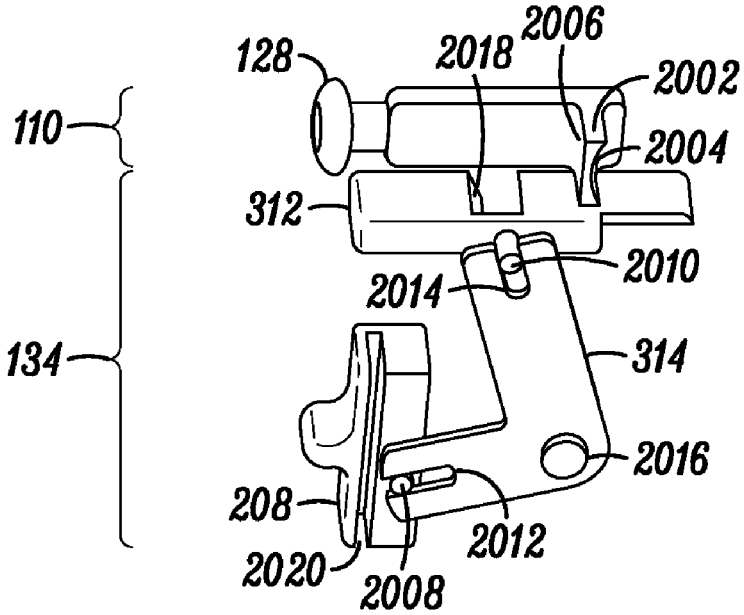

FIG. 20 is an upwardly-directed perspective view of a ball projector 110 and a ball loader assembly 134.

Figure 21:
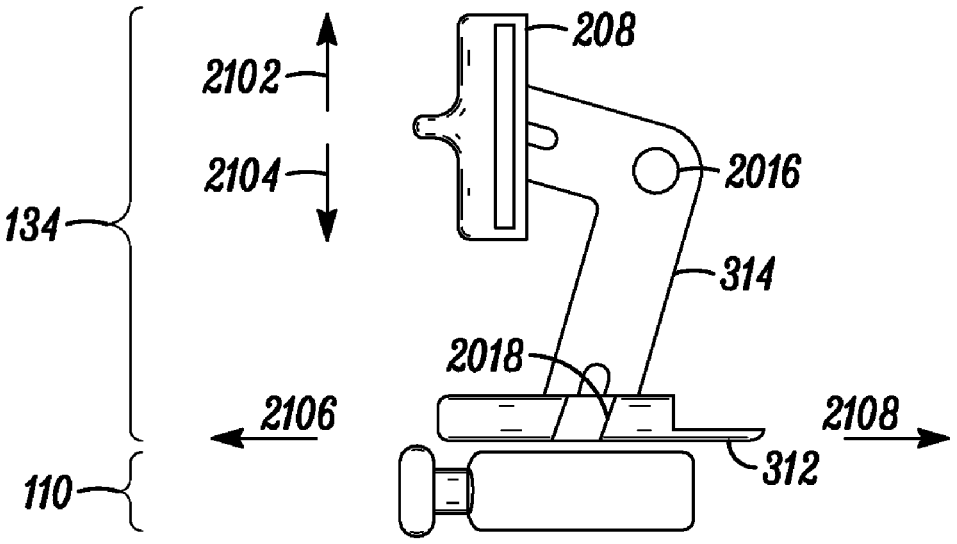

FIG. 21 is a top view of ball projector 110 and ball loader assembly 134.

Figure 22:
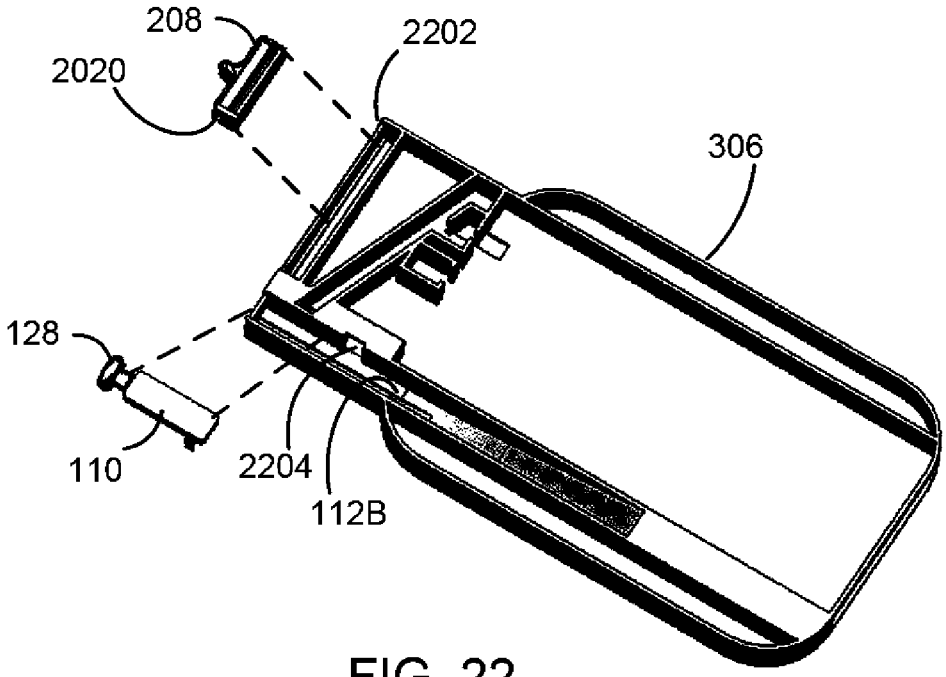

FIG. 22 is a perspective view of ball passage tray 306, ball projector 110, and a slide 208.

Figure 23:
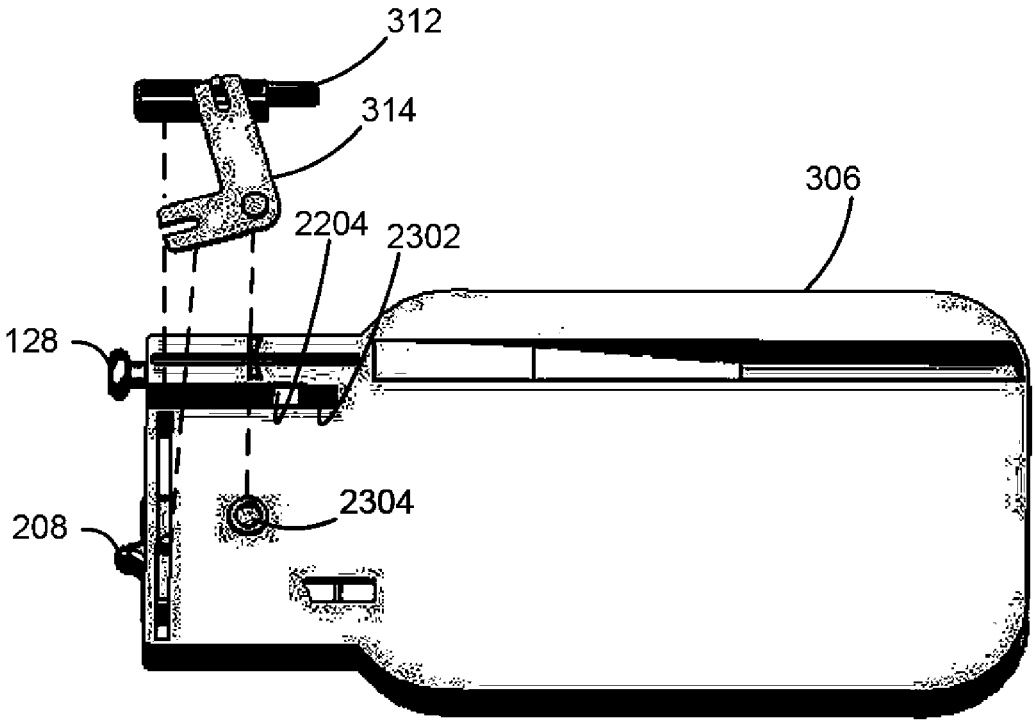

FIG. 23 is an upwardly directed perspective view of ball passage tray 306, a load elevator 312, and an elevator swing arm 314.

Figure 24:
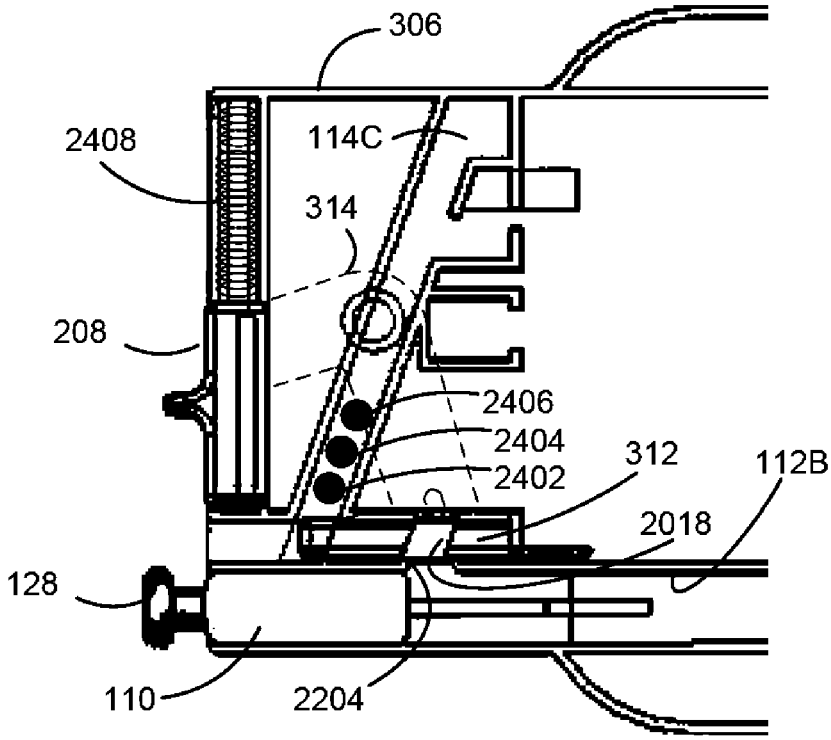

FIG. 24 is a semi-transparent top view of a portion of ball passage tray 306.

Figure 25:
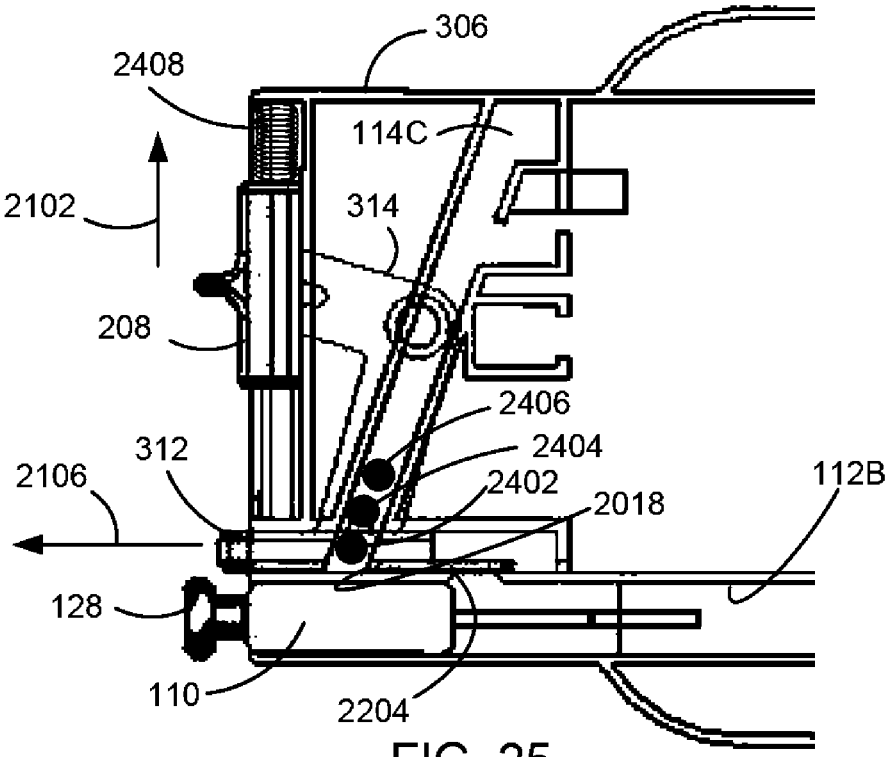

FIG. 25 is another semi-transparent top view of a portion of ball passage tray 306.

Figure 26:
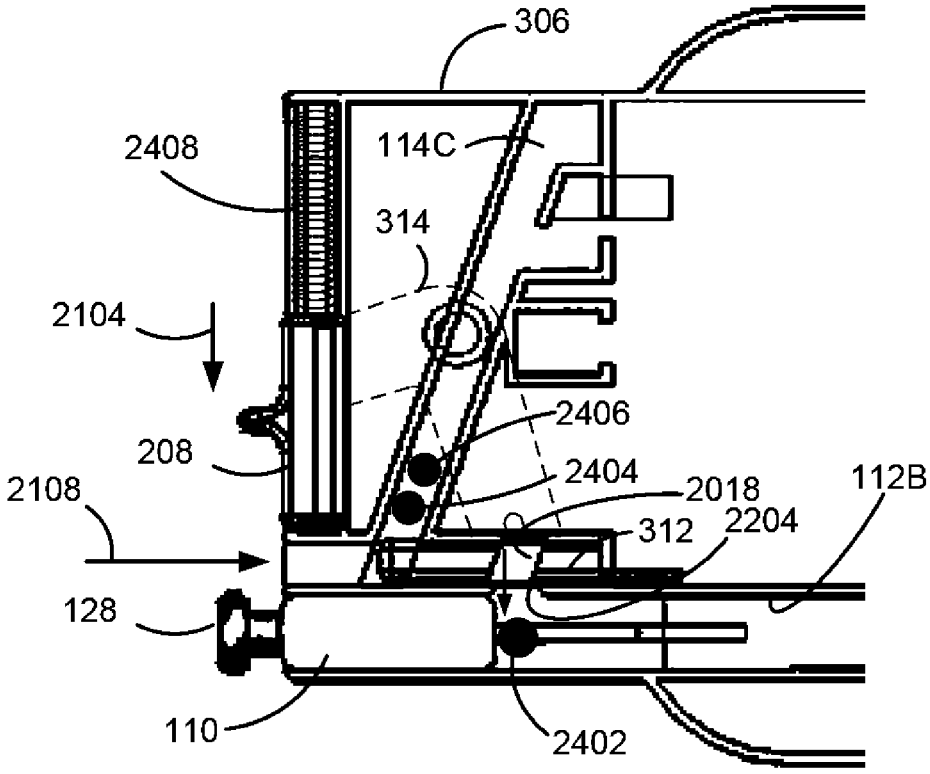

FIG. 26 is another semi-transparent top view of a portion of ball passage tray 306.

Figure 27:
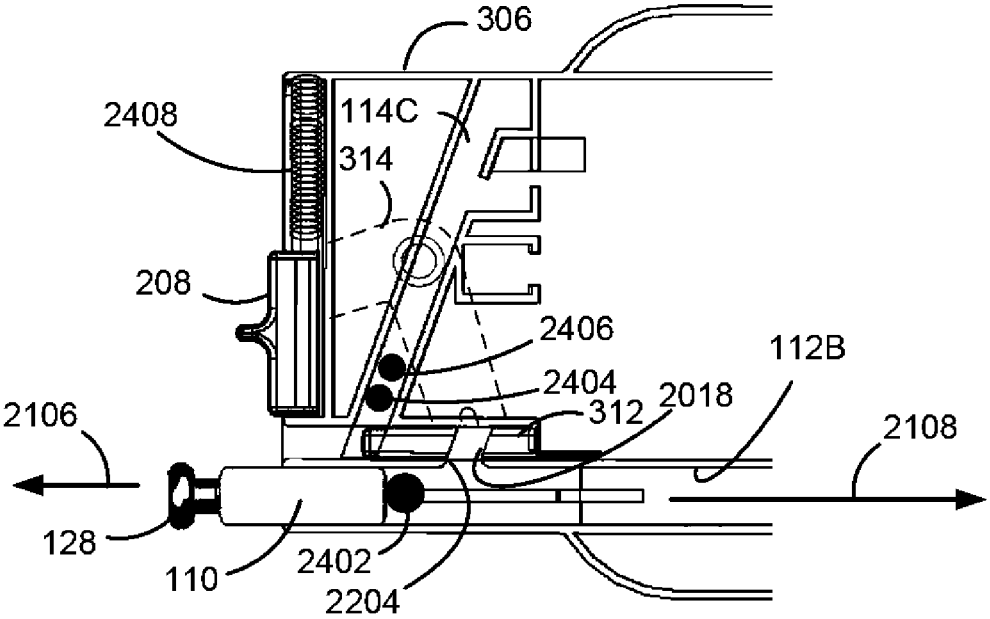

FIG. 27 is another semi-transparent top view of a portion of ball passage tray 306.

Figure 28:
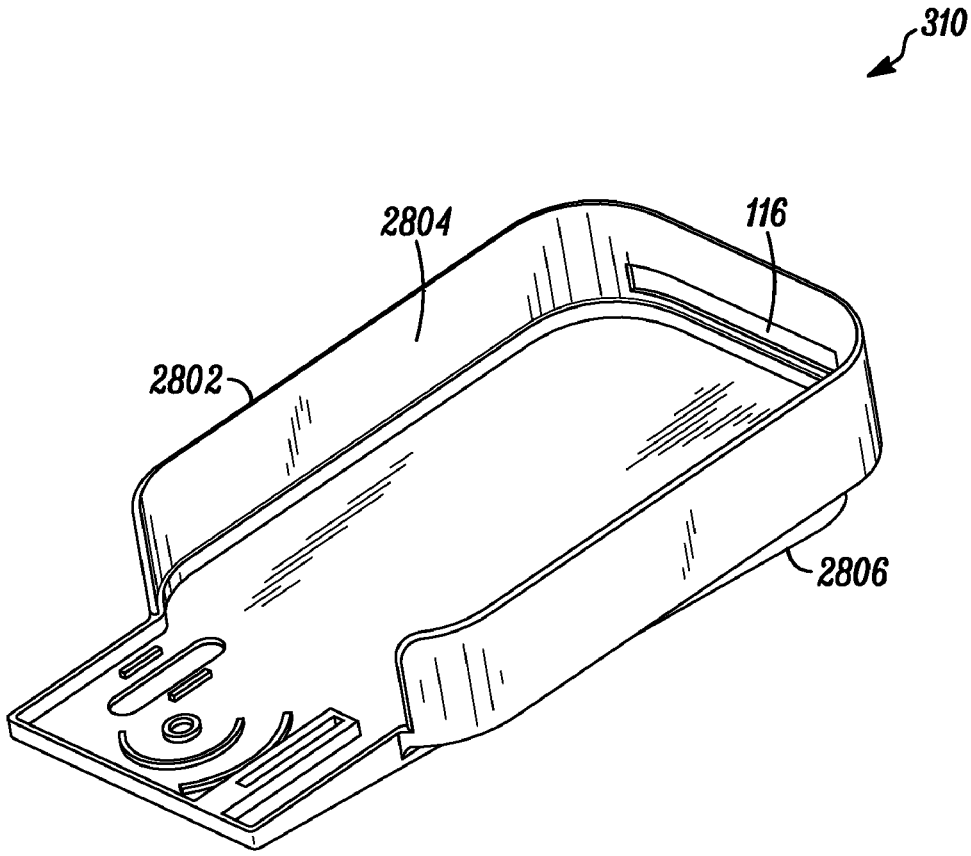

FIG. 28 is a perspective view of a base tray 310.

Figure 29:
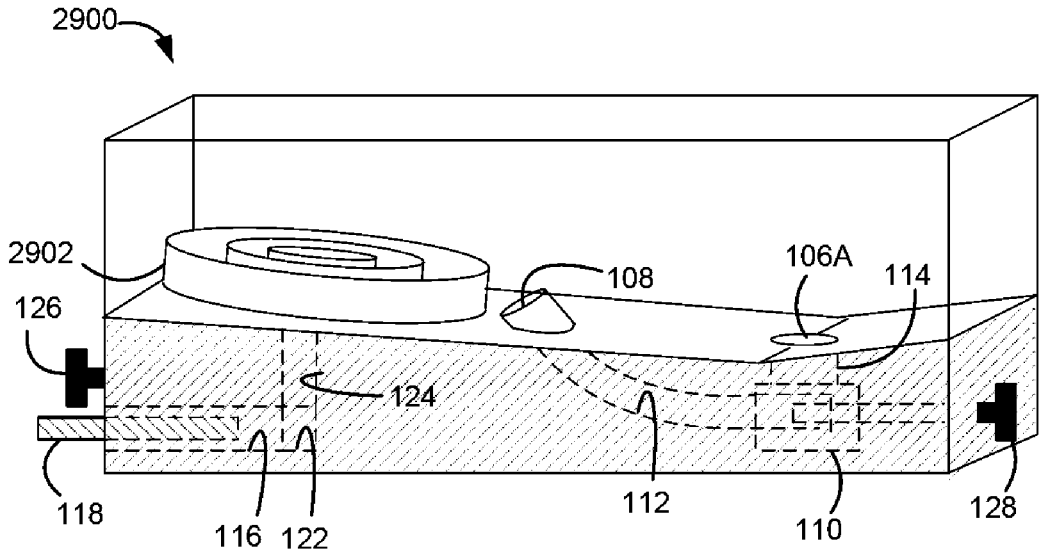

FIG. 29 is a perspective view of another exemplary ball projection game device 2900.

Figure 30:
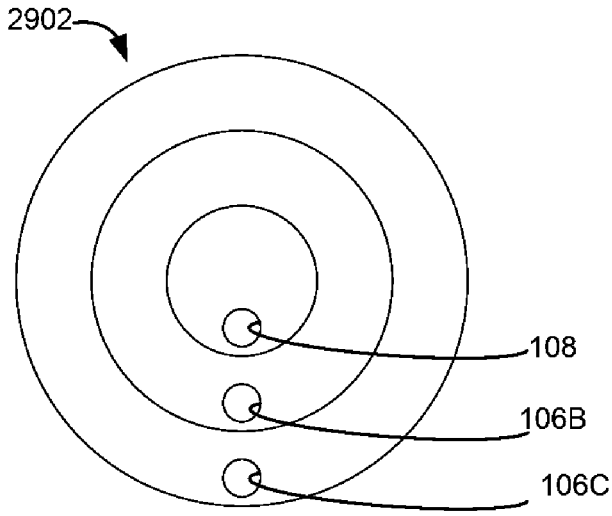

FIG. 30 is a top view of concentric rings corresponding to game device 2900.

In the drawings, the leftmost digit(s) of a reference number identifies the drawing in which the reference number first appears.

DETAILED DESCRIPTION

Disclosed herein are mechanical ball projection game devices, including game devices having mechanically-actuated ball loader assemblies, and game devices to release a tangible prize upon game balls reaching or entering a prize location.

Figure 1:
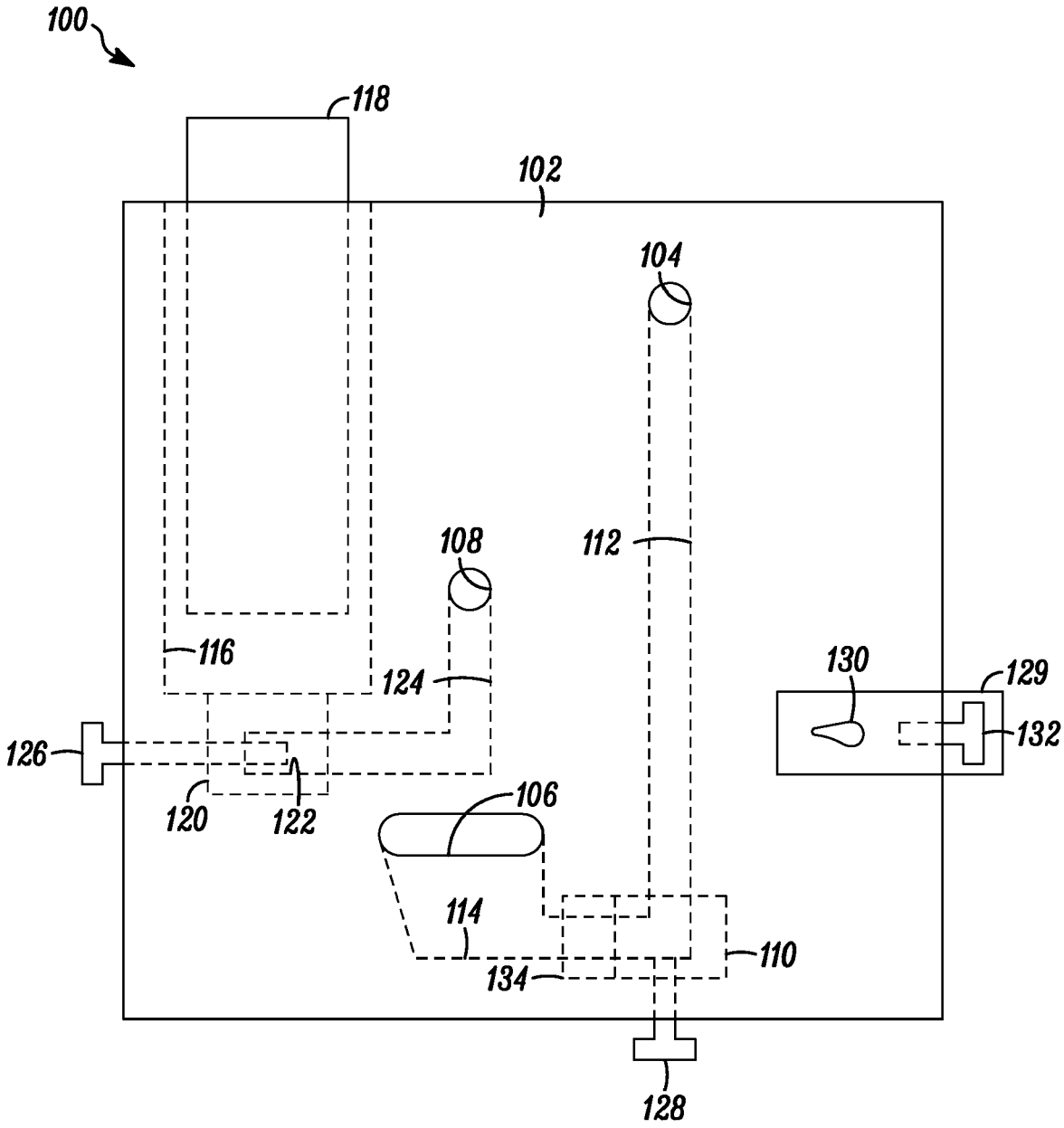
FIG. 1 is a block diagram of an exemplary ball projection game device 100.

FIG. 1 is a block diagram of an exemplary ball projection game device 100 having a game surface 102 including a plurality of openings therethrough. In the example of FIG. 1, game surface 102 includes a ball entry opening 104, a ball return opening 106, and a prize ball opening 108.

Game device 100 further includes a ball projector 110 to project a game ball through a ball entry passage 112 and onto game surface 102 through ball entry opening 104. Ball projector 110 may include a handle 128 to initiate ball projector 110 to project balls onto game surface 102.

Game device 100 further includes a ball return passage 114 to receive game balls from game surface 102 through ball return opening 106.

Game device 100 may include a ball reload assembly 134 to transfer game balls from ball return passage 114 to ball projector 110.

Game device 100 further includes a prize insert chamber 116 to receive a prize insert 118. Prize insert 118 may be configured to hold a relatively thin prize, such a paper currency, one or more gift cards, financial transaction cards, or greeting cards. Prize insert 118 may be configured to hold prizes of other dimensions, such as for toys and candy.

Game device 100 further includes an insert lock 120, having a prize ball cavity 122 to receive one or more game balls from game surface 102 through prize ball opening 108 and through a ball prize passage 124. Insert lock 120 is configured to secure prize insert 118 within prize chamber 116 when no balls are present in prize ball cavity 122, and to release prize inset 118 when at least one game ball is present in prize ball cavity 122. Insert lock 120 may be configured to release prize inset 118 when a plurality of game balls are present in ball cavity 122, and may be configured to release prize inset 118 when three game balls are present in ball cavity 122.

Insert lock 120 may be further configured to release prize inset 118 upon activation of a prize insert release member 126, illustrated in FIG. 1 as a depressible button, when the at least one game ball is present in prize ball cavity 122.

Game device 100 may include one or more of partitions, walls, posts, and other protrusions above game surface 102 to guide, direct, and/or obstruct game ball travel over game surface 102, examples of which are provided below. Such protrusions may extend from game surface 102, and/or may extend toward game surface 102 from a substantially optically transparent cover over game surface 102.

Game device 100 may include one or more user-interactive features 129 to direct, redirect, control, and/or influence game ball travel, such as one or more paddles 130, and one or more corresponding user-controllers, illustrated in FIG. 1 as a depressible button 132.

Figure 2:
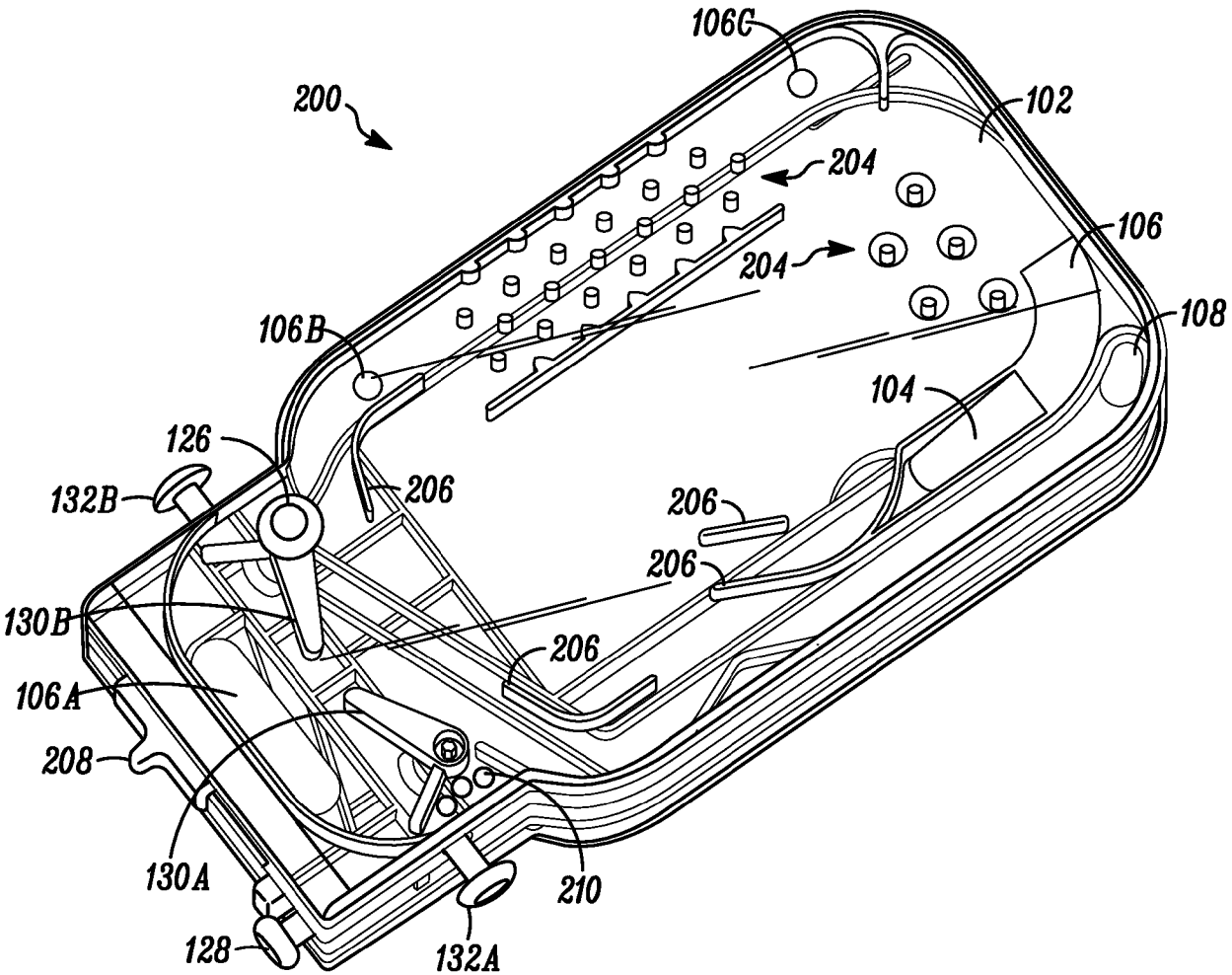
FIG. 2 is a semi-transparent perspective view of an exemplary ball projection game device 200.

FIG. 2 is a semi-transparent perspective view of an exemplary game device 200, which may be a pinball type game device.

Game device 200 includes game surface 102, ball entry opening 104, a plurality of ball return openings 106A, 106B, and 106C, and prize ball opening 108. Game device 200 further includes prize insert release button 126, ball projector handle 128, a plurality of paddles 130A and 130B, and corresponding depressible buttons 132A and 132B.

Ball projector handle 128 is configured to control a ball projector to project game balls onto surface 102 through ball entry opening 104. A plurality of protrusions 204 and partitions 206 serve as obstacles and ball guides as a player controls flippers 130A and 132B to direct game balls towards prize ball opening 108.

Game device 200 includes a ball loader assembly, including a slide 208 to reload game balls that pass through ball return openings 106A, 106B, and 106C, into a ball projector.

Figure 3:
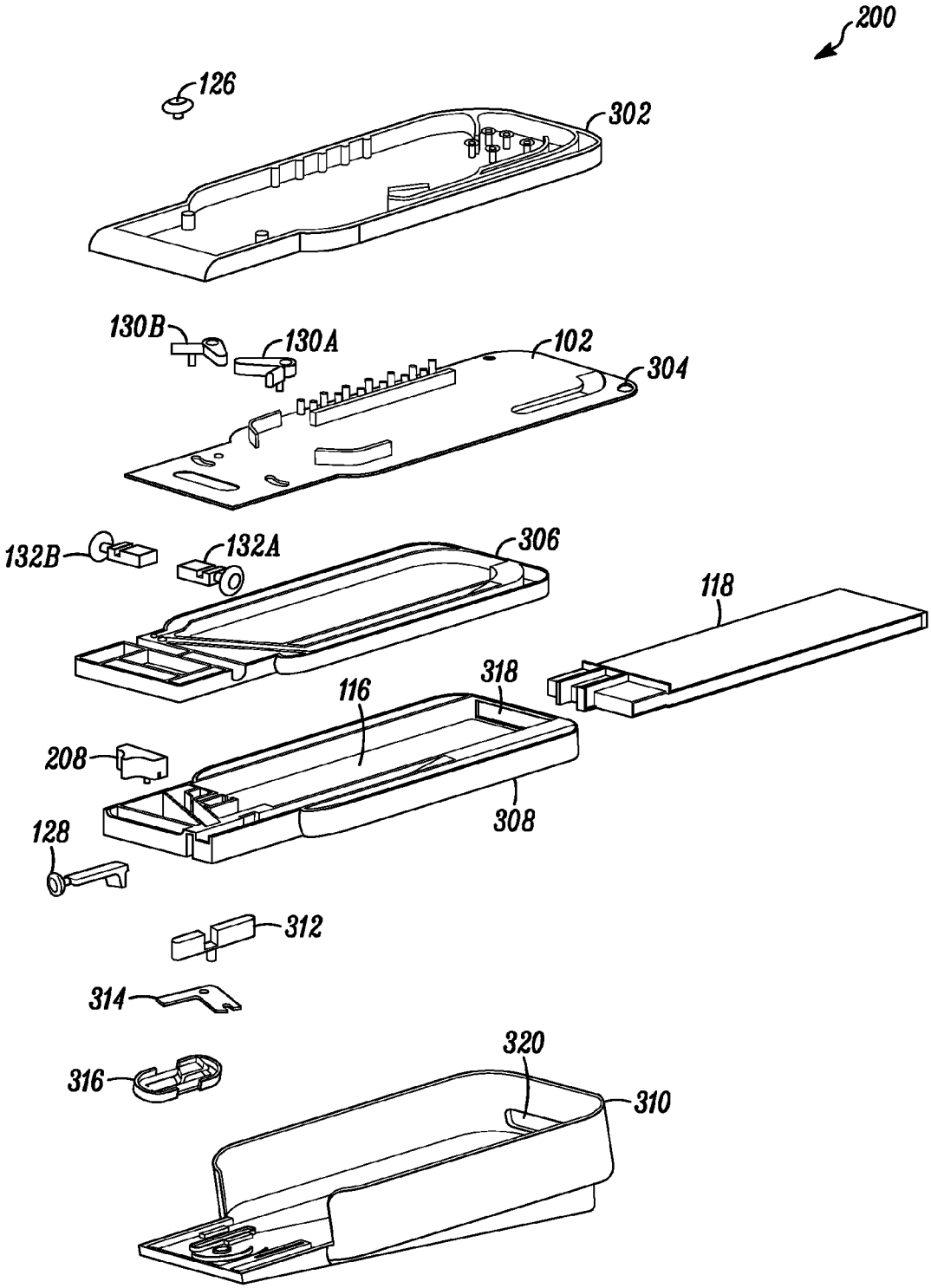
FIG. 3 is a perspective view of exemplary components of game device 200.

FIG. 3 is a perspective view of exemplary components of game device 200, including a substantially optically transparent cover 302, a game plate 304, including game surface 102, a ball passage tray 306, a reload and prize chamber tray 308, prize insert 118, and a base tray 310.

In the example of FIG. 2, game device 200 further includes a game ball reload elevator 312 and an elevator swing-arm 314, which, together with slide 208, function as ball reload assembly 134 in FIG. 1.

In the example of FIG. 2, game device 200 further includes a prize insert release clip 316, which, together with prize insert release member 126, function as insert lock 120 in FIG. 1.

In the example of FIG. 2, reload and prize chamber tray 308 and base tray 310 include prize insert slots 318 and 320, respectively, to receive prize insert 118 therethrough.

FIG. 4 is a perspective view of cover 302 and game plate 304, wherein cover 302 includes a plurality of protrusions 204A and partitions 206A extending therefrom towards game surface 102, and game surface 102 includes a plurality of protrusions 204B and partitions 206B extending therefrom towards cover 302.

Cover 302 may include pins 402 and 404 extending downwardly therefrom, and game plate 304 may include apertures or slots 406 and 408 and an opening 410 therethrough, which are described below with respect FIGS. 15 through 19.

Exemplary game ball flow through game device 200 is described below with respect to FIGS. 5, 6, and 7.

FIG. 5 is a top view of ball passage tray 306, including a portion 112A of ball entry passage 112 in FIG. 1, a portion 114A of ball return passage 114 in FIG. 1, including a ball return opening 504, a portion 114B of ball return passage 114 in FIG. 1, and ball prize passage 124, including a ball prize opening 506. Ball passage tray 306 further includes a ball return guide 502 to direct game balls through ball return passage portion 114B.

Ball passage tray 306 further includes depressible button recesses 508 and 510, which are described below with respect FIGS. 15 through 19.

FIG. 6 is a top view of reload and prize chamber tray 308, including a portion 112B of ball entry passage 112 in FIG. 1, a portion 114C of ball return passage 114 in FIG. 1, and ball cavity 122.

FIG. 7 is a perspective view of game plate 304, ball passage tray 306, and reload and prize chamber tray 308, including illustrations of exemplary ball travel.

Within reload and prize chamber tray 308, game balls enter ball entry passage portion 112B through an opening 702, as described below with respect to FIGS. 20 through 27. The game balls are projected up a ramp 706 of reload and prize chamber tray 308, along a path 704, through an opening and along ball entry passage portion 112A of ball passage tray 306, through ball entry opening 104 of game plate 304, and onto game surface 102.

When a game ball travels through ball return opening 106A of game plate 304, the ball travels along a path 708, through ball return passage portion 114B of ball passage tray 306, and directed by ball guide 502 into ball return passage portion 114C of reload and prize chamber tray 308. From ball return passage portion 114C, the ball may be reloaded into ball entry passage portion 112B, as described below with respect to FIGS. 20 through 27.

When a game ball travels through either of ball return openings 106B or 106C of game plate 304, the game ball travels along a path 710, including path 710A corresponding to ball return opening 106B, and path 710B corresponding to ball return opening 106C, through ball return passage portion 114A of ball passage tray 306, through ball return opening 504 (FIG. 5) of ball passage tray 306, and along ball return passage portion 114C of reload and prize chamber tray 308.

When a game ball travels through prize ball opening 108 of game plate 304, the ball travels along a path 712, through ball prize passage 124 of ball passage tray 306, through opening 506 (FIG. 5) of ball passage tray 306, and into ball cavity 122 (see 604 in FIG. 6) of reload and prize chamber tray 308.

Insert lock 120 is now described with reference to FIGS. 8 through 14.

FIG. 8 is a perspective view of ball passage tray 306, reload and prize chamber tray 308, prize insert 118, prize insert release button 126, and release clip 316.

FIG. 9 is a perspective view of release clip 316, including a frangible tab 902 having a pivot portion 904, a lock tab or detent 906, and a lock release portion 908. Release clip 316 includes a rear portion 910, discussed below with respect to FIG. 11.

FIG. 10 is a perspective view of prize insert 118, including a surface 1002 that faces reload and prize chamber tray 308. Surface 1002 includes a recess 1004 to receive detent 906 of release clip 316. In the example of FIG. 10, prize insert 118 further includes extensions 1006 and 1008, which are described further below.

Referring back to FIG. 6, reload and prize chamber tray 308 includes first and second openings 602 and 604 configured to align with detent 906 and lock release portion 908, respectively.

FIG. 11 is a perspective view of a rear surface 1102 of reload and prize chamber tray 308, which faces away from prize insert 118. In FIG. 11, prize insert release clip 316 is positioned relative to reload and prize chamber tray 308 so that rear portion 910 of prize insert release clip 316 faces away from reload and prize chamber tray 308.

FIG. 12 is a top view of reload and prize chamber tray 308 and prize insert 118, wherein prize insert 118 is partially positioned within prize chamber 116.

FIG. 13 is a top view of reload and prize chamber tray 308 and prize insert 118, wherein prize insert 118 positioned within prize chamber 116, in a locked position.

In FIG. 12, detent 906 of release clip 316 extends through opening 602 (FIG. 6) of reload and prize chamber tray 308 and into prize chamber 116, to engage recess 1004 (FIG. 10) of prize insert 118, when prize insert 118 is positioned within prize chamber 116 as illustrated in FIG. 13.

When prize insert 118 is positioned within prize chamber 116 as illustrated in FIG. 13, extension 1006 encloses a portion of ball cavity 122. Prize ball cavity 122 may be defined to include opening 506 (FIG. 5) of ball passage tray 306.

In FIG. 8, prize insert release button 126 may include a downwardly extending member aligned with opening 506 so that when the configured number of game balls are present within ball cavity 122, pressing of prize insert release button 126 exerts a force on the balls in ball cavity 122, which exert a force on lock release portion 908 of release clip 316, to cause frangible tab 902 to bend at pivot portion 904, and to cause detent 906 to disengage from recess 1004 of prize insert 118. The downwardly extending member of prize insert release button 126 may pass through pin 404 and opening 410 in FIG. 4.

Game device 200 may include one or more of a compression or tension assembly, which may include a spring, to at least partially eject prize insert 118 from reload and prize chamber tray 308 when detent 906 disengages from recess 1004. For example, in FIGS. 12 and 13, reload and prize chamber tray 308 include a recess to receive a compressible spring 1202, to engage extension 1008 of prize insert 118.

Game device 200 may be configured to preclude prize insert 118 from completely exiting reload and prize chamber tray 308. For example, FIG. 14 is a perspective view of prize insert 118 including an extension 1402 to retain prize insert 118 at least partially within game device 200.

Paddles 130 and depressible buttons 132 are described below with reference to FIGS. 15 though 19.

FIG. 15 is a perspective view of game plate 304, ball passage tray 306, paddles 130A and 130B, and depressible buttons 132A and 132B.

FIG. 16 is a perspective view of paddle 130B, including a paddle portion 1602, a swing arm 1604, a pivot aperture 1606, and a guide pin 1608. Pivot aperture 1606 is configured to receive pin 404 of cover 302 (FIG. 4). Guide pin 1608 is configured to fit within slot 408 of cover 302 (FIG. 4).

FIG. 17 is a perspective view of depressible button 132B, including a body 1702 having a recess 1704 therein to receive guide pin 1608 of paddle 130B. Body 1702 is configured to slideably fit within recess 510 of ball return tray 306.

FIG. 18 is a top view of paddle 130B and depressible button 132B.

FIG. 19 is a side view of paddle 130B and depressible button 132B.

In operation, and with reference to FIG. 18, when depressible button 132B is moved in a direction 1802, side walls of recess 1704 cause guide pin 1608 to move in direction 1802. As guide pin 1608 moves in direction 1802, swing arm 1604 and paddle portion 1602 pivot about pivot aperture 1606 in a direction 1804, and guide pin 1608 moves within recess 1704 in a direction 1806.

Swing arm 1604 may serve as a game ball restraint, such as during transit, to retain game balls within an area 210 of FIG. 2.

Game device 200 may include a retractable element to retract depressible button 132B and paddle 130B, which may include one or more of a tension and compression element, such as a compressible spring positioned within recess 510 of ball return tray 306.

Paddle 130A and depressible button 132A may be configured substantially as a mirror image of paddle 130B and depressible button 132B.

Ball projector 110 and ball reload assembly 134 are described below with reference to FIGS. 20 through 27.

FIG. 20 is an upwardly-directed perspective view of ball projector 110 and ball loader assembly 134, including projector handle 128, slide 208, reload elevator 312, and elevator swing-arm 314.

Ball projector 110 includes a partition 2002 having a first surface 2004 to contact a game ball and a second surface 2006 to contact a compression assembly, which may include a spring.

Slide 208 includes a pin 2008 extending downwardly therefrom.

Reload elevator 312 includes a pin 2010 extending downwardly therefrom.

Elevator swing-arm 314 includes first and second recesses 2012 and 2014 to receive pins 2008 and 2010, respectively. Elevator swing-arm 314 further includes a pivot pin 2016, described further below.

Load elevator 312 further includes an elevator cavity 2018 to receive game balls from ball return passage 114C, as described below.

Slide 208 further includes a guide recess 2020, described below.

FIG. 21 is a top view of ball projector 110 and ball loader assembly 134.

Slide 208 is slideably moveable in directions 2102 and 2104, to cause swing arm 314 to pivot about pivot pin 2016, and to cause elevator 312 to move in a directions 2106 and 2108, respectively.

Ball projector 110 is slideably moveable in directions 2106 and 2108, independent of ball loader assembly 134.

FIG. 22 is a perspective view of ball passage tray 306, ball projector 110, and slide 208. In the example of FIG. 22, ball projector 110A may be slideably positioned within ball entry passage portion 112B, and a side wall 2202 of ball passage tray 306 may be configured to slideably engage within guide recess 2020 of slide 208. Ball passage tray 306 includes an opening 2204 in a wall of ball entry passage portion 112B, to a recess 2302 (FIG. 23, described below), of ball passage tray 306.

FIG. 23 is an upwardly directed perspective view of ball passage tray 306, load elevator 312, and elevator swing arm 314. In the example of FIG. 23, load elevator 312 may be slideably positioned within recess 2302 of ball passage tray 306, and pivot pin 2216 of elevator swing arm 314 may be rotatably positioned within a pivot recess 2304 of ball passage tray 306.

Exemplary operation of ball loader assembly 134 is described below with respect to FIGS. 24 and 25.

FIG. 24 is a semi-transparent top view of a portion of ball passage tray 306, including a plurality of game balls 2402, 2404, and 2406 within ball return passage portion 114C, and a bias assembly, illustrated here as a compressible spring 2408 positioned within a recess of ball passage tray 306 to bias slide 208, elevator 312, and elevator swing arm 314 in the positions illustrated in FIG. 24.

FIG. 25 is another semi-transparent top view of a portion of ball passage tray 306, wherein slide 208 has moved in direction 2102 and elevator 312 has moved in direction 2106 to align elevator cavity 2018 of elevator 312 with ball return passage portion 114C, and to receive ball 2402 within elevator cavity 2018. Compressible spring 2408 is in a relatively compressed position.

FIG. 26 is another semi-transparent top view of a portion of ball passage tray 306, wherein slide 208 is released to allow compressible spring 2408 to move slide 208 in direction 2104 and elevator 312 in direction 2108, to align elevator cavity 2018 with opening 2204. Elevator cavity 2018 may be configured so that ball 2402 rolls into ball entry passage 112B upon the alignment. For example, elevator cavity 2018 may include a surface that is angled such that when ball passage tray 306 is tilted, as described below with respect to FIG. 28, ball 2402 rolls into ball entry passage 112B upon the alignment.

Exemplary operation of ball projector 110 is described below with respect to FIG. 27.

FIG. 27 is another semi-transparent top view of a portion of ball passage tray 306, wherein handle 128 is moved in direction 2106 to cause ball projector 110 to engage a tension or compression feature, such as a compressible spring. Upon release of handle 128, the compression or tension feature responds to cause ball projector 110 to project ball 2402 through ball entry passage 112B in direction 2108.

FIG. 28 is a perspective view of base tray 310, including a side wall 2802 defining a recess 2804 therein to receive game plate 304, ball passage tray 306, and reload and prize chamber tray 308, including prize insert 118. Side wall 2802 may be configured to mate with cover 302, such as with one or more of interlocking components, adhesive, and heat treatment.

In the example of FIG. 28, base tray 310 includes an elevated portion 2806 to maintain game surface 102 on an angle such that when game balls are projected onto game surface 102 through ball entry opening 104, the game balls tend to roll downwardly towards paddles 130 and ball return opening 106A.

In addition to cover 302, one or more other portions of game device 200 may be substantially optically transparent to allow viewing of one or more of contents of prize insert 118, internal game ball motion, and internal component movements.

FIG. 29 is a perspective view of another exemplary ball projection game device 2900, including features of game device 100, and further including plurality of concentric rings 2902. FIG. 30 is a top view of concentric rings 2902, including prize ball opening 108, and additional ball return openings 106B and 106C.

One or more features described herein may be implemented with one or more of a variety of materials including, without limitation, plastic, metal, wood, glass, and combinations thereof.

Game devices, as disclosed herein, may be implemented without a tangible prize feature.

Methods and systems are disclosed herein with the aid of functional building blocks illustrating functions, features, and relationships thereof. At least some of the boundaries of these functional building blocks have been arbitrarily defined herein for the convenience of the description. Alternate boundaries may be defined so long as the specified functions and relationships thereof are appropriately performed.

For example, in FIG. 3, game device 200 is illustrated as a multi-level game device. Implementation of a game device with multiple levels may reduce manufacturing complexity and costs. Features described herein as implemented in different levels, may be implemented within a common level.

While various embodiments are disclosed herein, it should be understood that they have been presented by way of example only, and not limitation. It will be apparent to persons skilled in the relevant art that various changes in form and detail may be made therein without departing from the spirit and scope of the methods and systems disclosed herein. Thus, the breadth and scope of the claims should not be limited by any of the exemplary embodiments disclosed herein.

What is claimed is:

1. A game apparatus, comprising:

a housing including a game surface, wherein the game surface has a ball return opening therethrough to a ball return passage within the housing, and a prize-ball opening to a prize ball passage within the housing;

a mechanical ball projector to project a ball onto the game surface;

a mechanical ball reload assembly to transfer balls from the ball return passage to the ball projector responsive to user action;

a prize insert slideably insertable within the housing, the prize insert including a prize compartment therein; and an insert lock to releasably secure the prize insert within the housing and to release the prize insert from the housing when at least one ball is in the prize ball chamber.

2. The game apparatus of claim 1, wherein the ball reload assembly comprises:

a manually-operable slide movable in a first direction extending from the housing;

a ball elevator having a ball cavity therein to receive a ball from the ball return passage, wherein the ball elevator is slideably movable in a second direction;

a pivotable swing-arm coupled to the slide and to the ball elevator to move the ball elevator in the second direction in response to movement of the manually-operable slide in the first direction; and a bias system to bias the ball loader assembly in a first position.

3. The game apparatus of claim 1, further comprising:

a user-controllable paddle proximate to the game surface to redirect game balls over the game surface responsive to user action, the user-controllable paddle including a retractable swing-arm to retain game balls within a confined area of the game surface during transit.

4. The game apparatus of claim 1, wherein the insert lock comprises:

a frangible tab including a detent extending therefrom to engage the prize insert, and a lock release portion in alignment with the prize ball chamber; and a depressible button in alignment with the prize ball chamber to exert a force on the lock release portion through the at least one ball in the prize ball chamber.

5. The game apparatus of claim 4, wherein the prize insert includes a recess in a surface thereof to receive the insert lock detent.

6. The game apparatus of claim 1, further comprising a compressible spring to at least partially eject the prize insert from the housing upon disengagement of the insert lock.

7. The game apparatus of claim 1, wherein the prize insert chamber is configured to receive one or more of paper currency and a gift card.

8. The game apparatus of claim 1, wherein the prize insert includes a partition extending therefrom to enclose a portion of the prize ball chamber when the prize insert is in a locked position within the housing, wherein the prize ball chamber is exposed to the ball return passage when the prize insert is not in the locked position.

9. A game apparatus, comprising:

a housing including a game surface having a prize ball opening therethrough to a prize ball chamber within the housing;

a ball projector to project a ball onto the game surface;

a prize insert slideably insertable within the housing, the prize insert including a prize compartment therein; and an insert lock to releasably secure the prize insert within the housing and to release the prize insert from the housing when at least one ball is in the prize ball chamber.

10. The game apparatus of claim 9, wherein the insert lock comprises:

a frangible tab including a detent extending therefrom to engage the prize insert, and a lock release portion in alignment with the prize ball chamber; and a depressible button in alignment with the prize ball chamber to exert a force on the lock release portion through the at least one ball in the prize ball chamber.

11. The game apparatus of claim 10, wherein the prize insert includes a recess in a surface thereof to receive the insert lock detent.

12. The game apparatus of claim 9, further comprising a compressible spring to at least partially eject the prize insert from the housing upon disengagement of the insert lock.

13. The game apparatus of claim 9, wherein the prize insert includes a partition extending therefrom to enclose a portion of the prize ball chamber when the prize insert is in a locked position within the housing, wherein the prize ball chamber is exposed to a ball return passage when the prize insert is not in the locked position.

14. The game apparatus of claim 9, wherein the prize insert chamber is configured to receive one or more of paper currency and a gift card.

15. The game apparatus of claim 9, further comprising:

a user-controllable paddle proximate to the game surface to redirect game balls over the game surface responsive to user action, the user-controllable paddle including a swing-arm to retain game balls within a confined area of the game surface during transit.

16. The game apparatus of claim 9, further comprising:

a game plate having the game surface thereon;

a substantially optically transparent cover positioned above the game plate; and at least one additional tray including the ball projector, a prize insert cavity to receive the prize insert, and a plurality of ball passages between openings in the game surface and the ball projector and the prize ball cavity.

17. The game apparatus of claim 16, wherein the at least one additional tray includes:

a ball reload and prize chamber tray having the prize insert cavity and a ball projector recess to receive the ball projector; and a ball passage tray positioned between the game plate and the ball reload and prize chamber tray, the ball passage tray having the a plurality of ball passages between openings in the game surface and the ball projector and the prize ball cavity.

* * * * *